US006345550B1

(12) United States Patent
Markham et al.

(10) Patent No.: US 6,345,550 B1
(45) Date of Patent: Feb. 12, 2002

(54) GUIDE FOR ADJUSTABLE PAD ON PEDAL ARM

(75) Inventors: Anthony Markham, Windsor (CA); Christopher Bortolon, Clawson, MI (US); Christopher Rixon, Tecunseh (CA)

(73) Assignee: Teleflex Incorporated, Plymouth Meeting, PA (US)

( * ) Notice: Subject to any disclaimer, the term of this patent is extended or adjusted under 35 U.S.C. 154(b) by 0 days.

(21) Appl. No.: 09/533,637

(22) Filed: Mar. 22, 2000

Related U.S. Application Data

(60) Provisional application No. 60/159,663, filed on Oct. 15, 1999.

(51) Int. Cl.[7] ..... G05G 1/16
(52) U.S. Cl. ..... 74/512; 74/478.5; 74/562
(58) Field of Search ..... 74/512, 513, 560, 74/562, 562.5, 478.5

(56) References Cited

U.S. PATENT DOCUMENTS 1,236,400 A * 8/1917 Brown ..... 74/562
1,484,847 A * 2/1924 Rivers et al. ..... 74/562
2,124,100 A * 7/1938 Bailey ..... 74/562
4,450,733 A * 5/1984 Rantapaa ..... 74/562
5,839,326 A * 11/1998 Song ..... 74/562
6,167,778 B1 * 1/2001 Kohlen ..... 74/560
6,209,417 B1 * 4/2001 Munger et al. ..... 74/560
6,212,970 B1 * 4/2001 Bortolon ..... 74/560

* cited by examiner

*Primary Examiner*—David A. Bucci
*Assistant Examiner*—Chong H. Kim
(74) *Attorney, Agent, or Firm*—Howard & Howard

(57) ABSTRACT

An adjustable pedal assembly for an automotive vehicle including a plurality of screw members (30, 130, 32, 132 and 42, 142) interconnected by threads for adjusting the position of q pedal pad (20, 120) along the adjustment axis A relative to a pedal arm (14, 114.) A first telescoping element (24, 124) and a second telescoping element (26, 126) which are in sliding engagement with one another along a telescoping axis for interconnecting the pedal pad (20, 120) and the pedal arm (14, 114) for stabilizing the movement of the pedal pad (20, 120) relative to a pedal arm (14, 114) along the adjustment axis A.

13 Claims, 5 Drawing Sheets

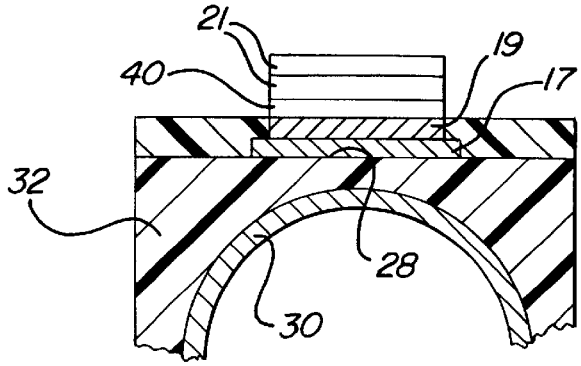
FIG-5
FIG-6
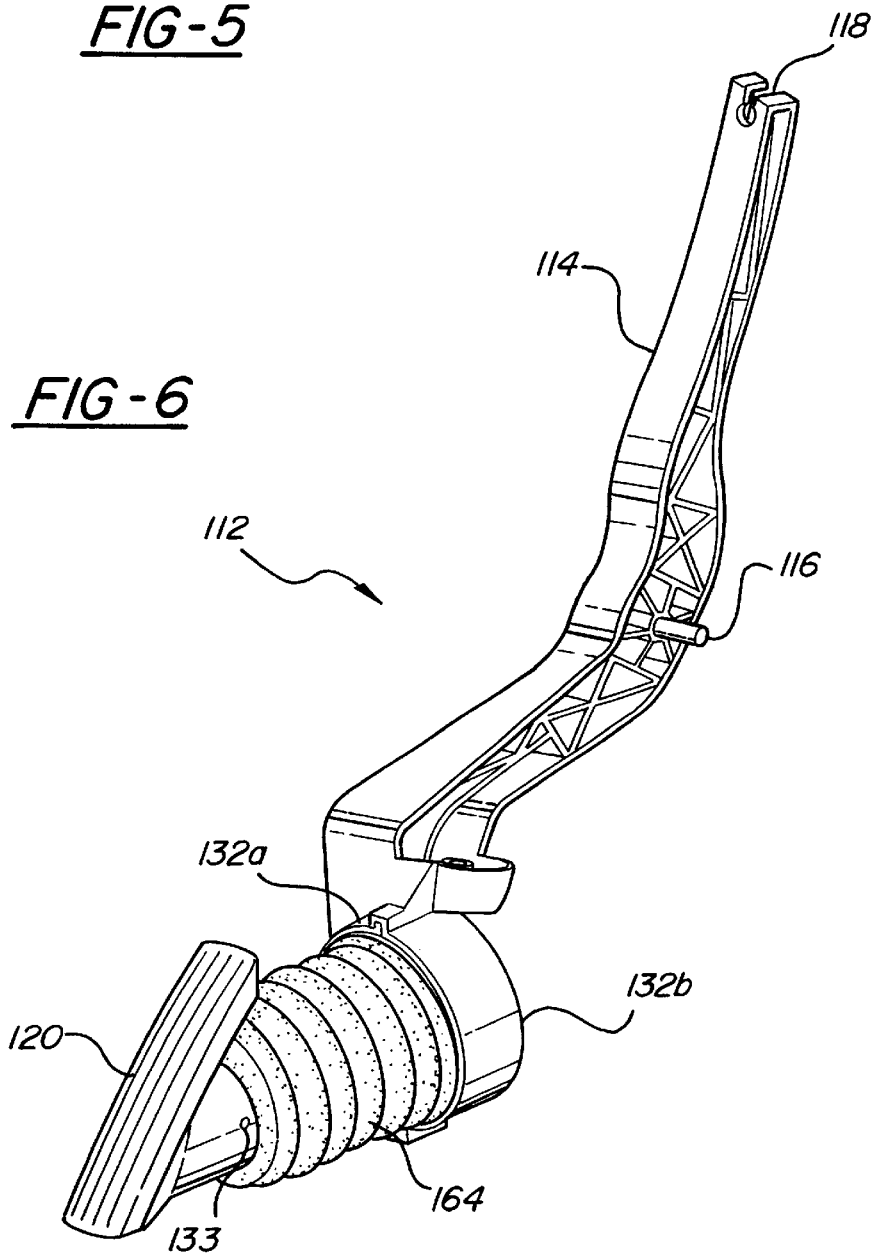

GUIDE FOR ADJUSTABLE PAD ON PEDAL ARM

RELATED APPLICATION

This application claims the benefits of provisional application Ser. No. 60/159,663 filed Oct. 15, 1999.

BACKGROUND OF THE INVENTION

1. Field of the Invention

An adjustable pedal assembly for an automotive vehicle wherein the distance the pedal pad is disposed from the pedal arm may be adjusted.

2. Description of the Prior Art

In such assemblies, a support supports the pedal arm for pivotal movement on a vehicle and a pedal pad receives forces for pivoting the pedal arm to apply the brakes or actuate the throttle in an automotive vehicle. An adjuster supports the pedal pad on the distal end of the pedal arm for adjusting the position of the pedal pad relative to the pedal arm along an adjustment axis. An example of such an assembly is disclosed in U.S. Pat. No. 5,884,532 to Rixon et al and U.K. Patent application 2,332,264 published Jun. 16, 1999.

It is most efficient to utilize one adjuster as compared to two adjusters as shown in the aforementioned U.S. Patent. However, when one adjuster is utilized as shown in the aforementioned U.K. Patent application, tolerances in the adjuster frequently allow unstabilized and undesirable lateral movement of the pedal pad relative to the pedal arm.

SUMMARY OF THE INVENTION AND ADVANTAGES

The invention provides an adjustable pedal assembly for an automotive vehicle wherein a pedal arm having a distal end is supported for pivotal movement on a vehicle by a support. A pedal pad receives forces for pivoting the pedal arm relative to the support and an adjuster supports the pedal pad on the distal end of the pedal arm for adjusting the position of the pedal pad relative to the pedal arm along an adjustment axis. The assembly is characterized by a guide interconnecting the pad and the pedal arm for stabilizing the movement of the pad relative to the pedal arm along the adjustment axis.

Accordingly, the subject invention provides an adjustable pedal pad that is adjusted by one adjuster yet is stabilized in lateral movement by a separate guide, i.e., a guide that is independent of the adjuster.

BRIEF DESCRIPTION OF THE DRAWINGS

Other advantages of the present invention will be readily appreciated, as the same becomes better understood by reference to the following detailed description when considered in connection with the accompanying drawings wherein:

FIG. 5 is a fragmentary cross sectional view taken along line 5—5 of FIG. 4;

FIG. 6 is a perspective view of a second embodiment with the pedal pad in the extended position.

DETAILED DESCRIPTION OF THE PREFERRED EMBODIMENT

Figure 1:
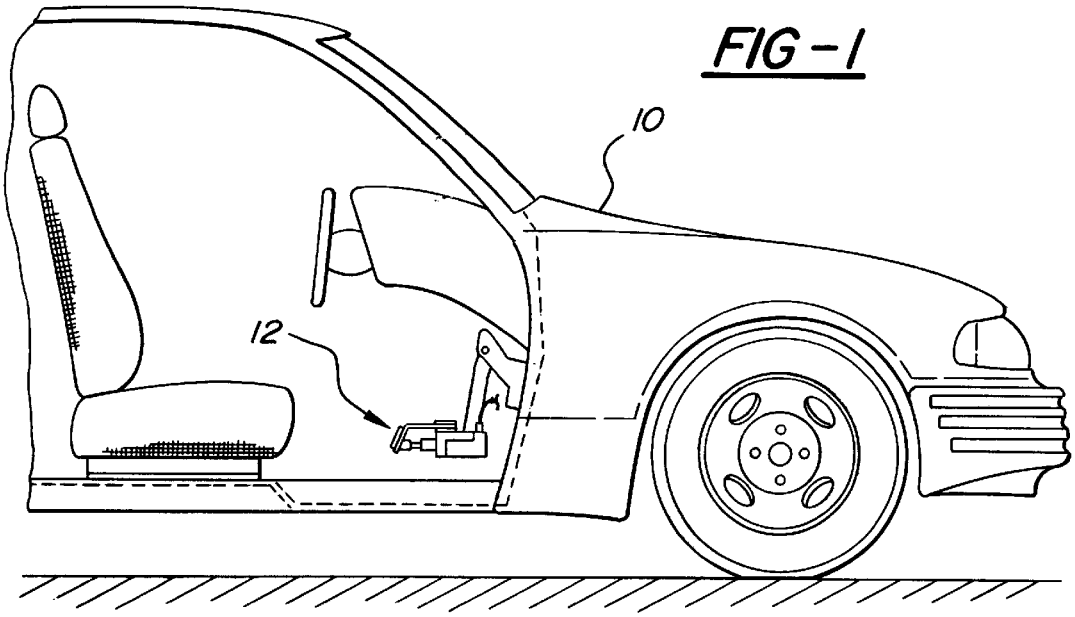
FIG. 1 is an environmental view showing the subject invention in an automotive vehicle.
Figure 2:
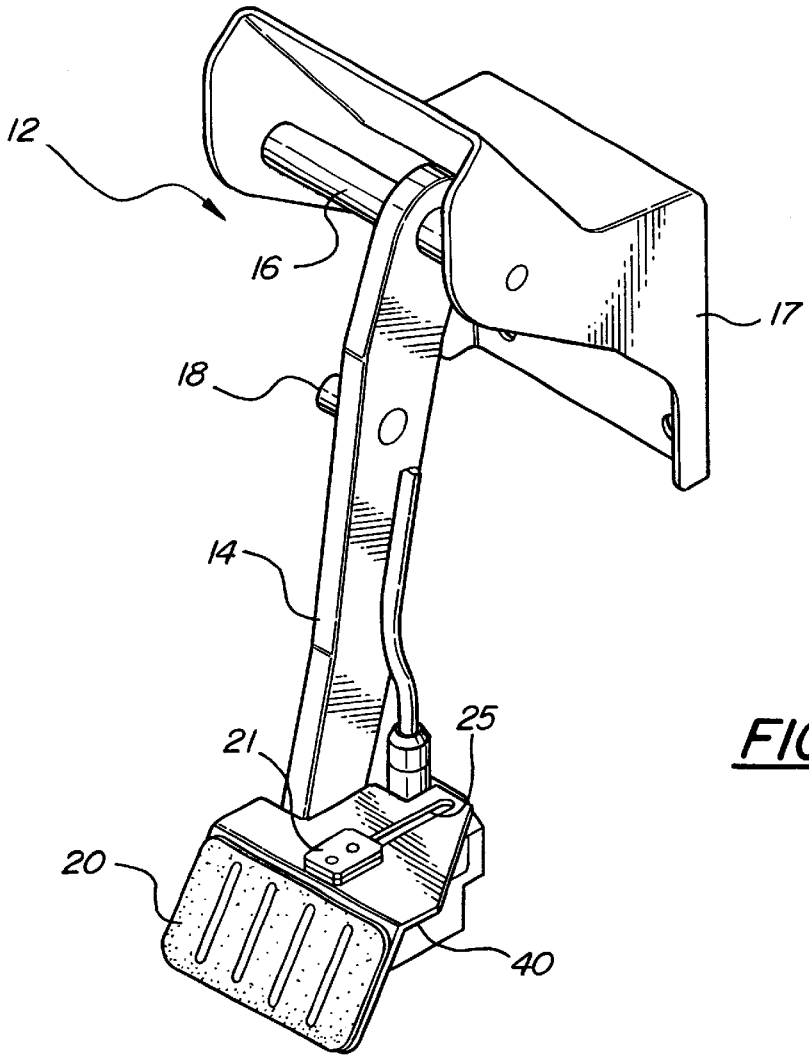
FIG. 2 is a perspective view of a first embodiment of the invention showing the pedal pad in the retracted position.
Figure 3:
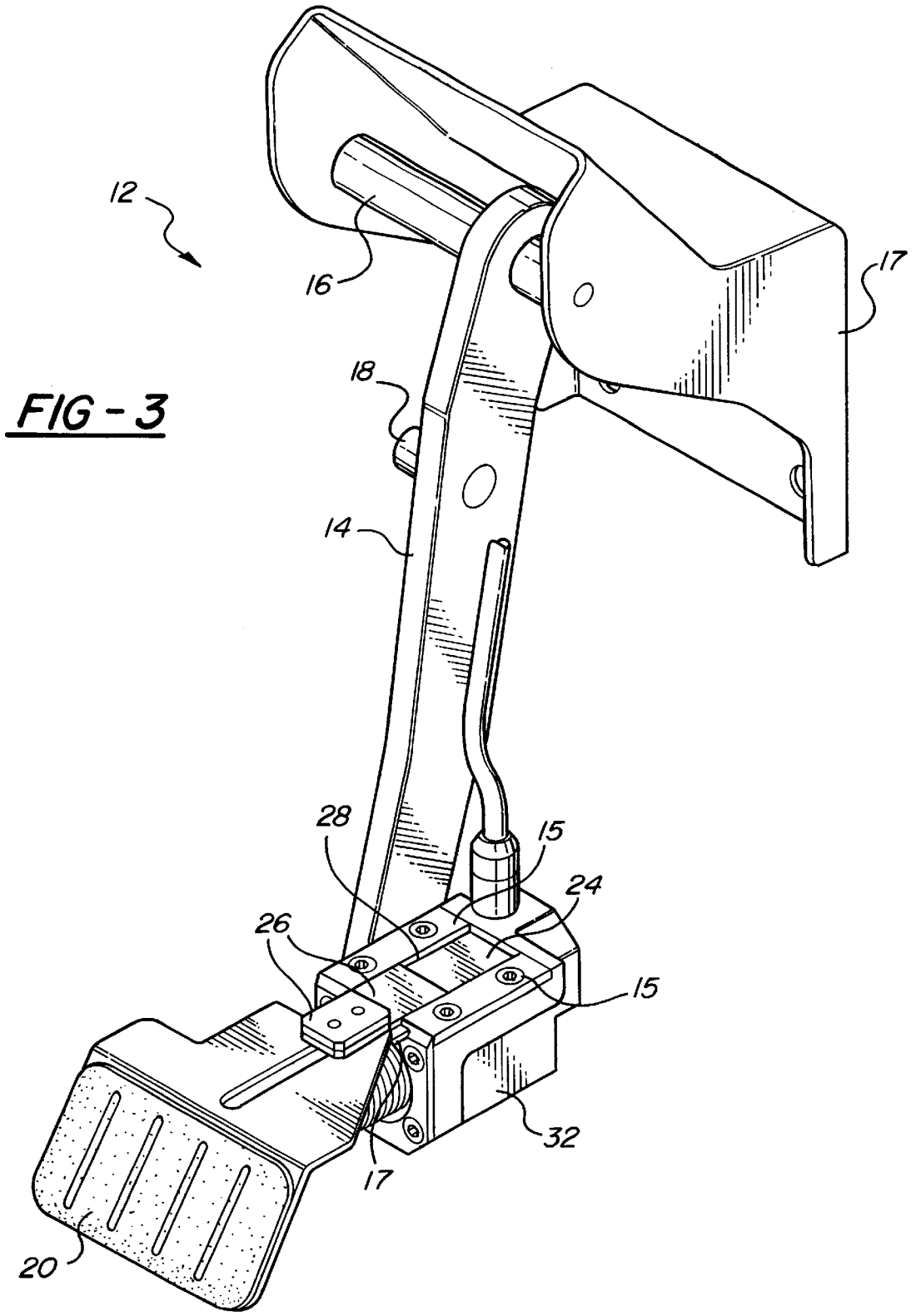
FIG. 3 is a perspective view similar to FIG. 2 but showing the pedal pad in the extended position.
Figure 4:
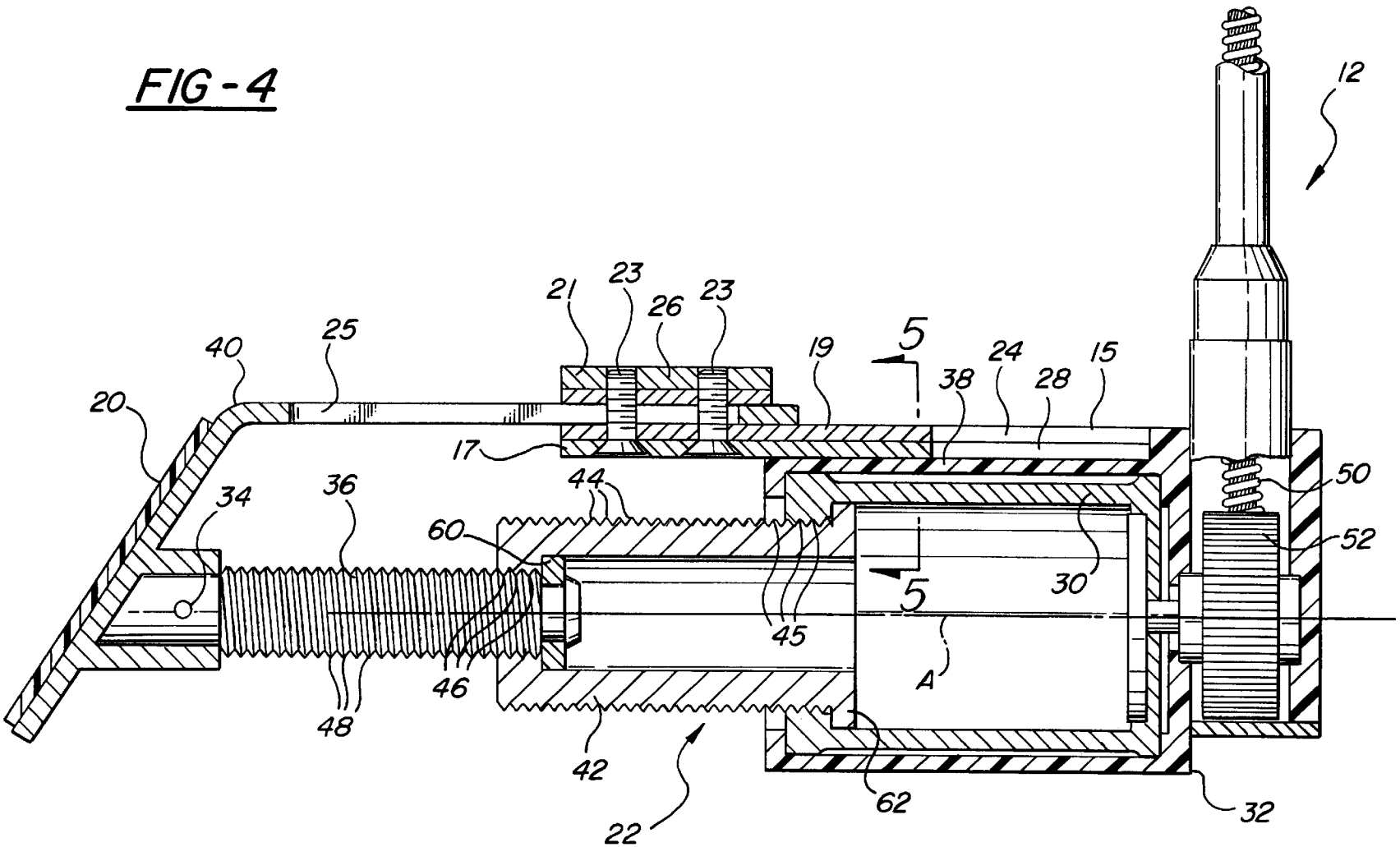
FIG. 4 is a cross sectional view of the first embodiment in the extended position.

Referring to the Figures, wherein like numerals differing by one hundred indicate like or corresponding parts throughout the several views, a first embodiment of an adjustable pedal assembly is generally shown at 12 and a second embodiment is generally shown at 112 for use in an automotive vehicle 10.

The assembly includes a pedal arm 14, 114 having a distal or lower end and supported by a support 16, 116 supporting the pedal arm 14, 114 for pivotal movement on a vehicle 10. The support 16, 116 comprises a shaft, which is supported on the vehicle 10 by a bracket 17, or the like. The pedal arm 14, 114 may be rotated on the shaft or fixed to the shaft with the shaft rotatable relative to the vehicle 10. A control attachment 18, 118 is included on the pedal arm 14, 114 for connection to a brake or accelerator control.

A pedal pad 20, 120 receives forces for pivoting the pedal arm 14, 114 and an adjuster, generally shown at 22 and 122, supports the pedal pad 20, 120 on the distal end of the pedal arm 14, 114 for adjusting the position of the pedal pad 20, 120 relative to the pedal arm 14, 114 along an adjustment axis A.

Figure 7:
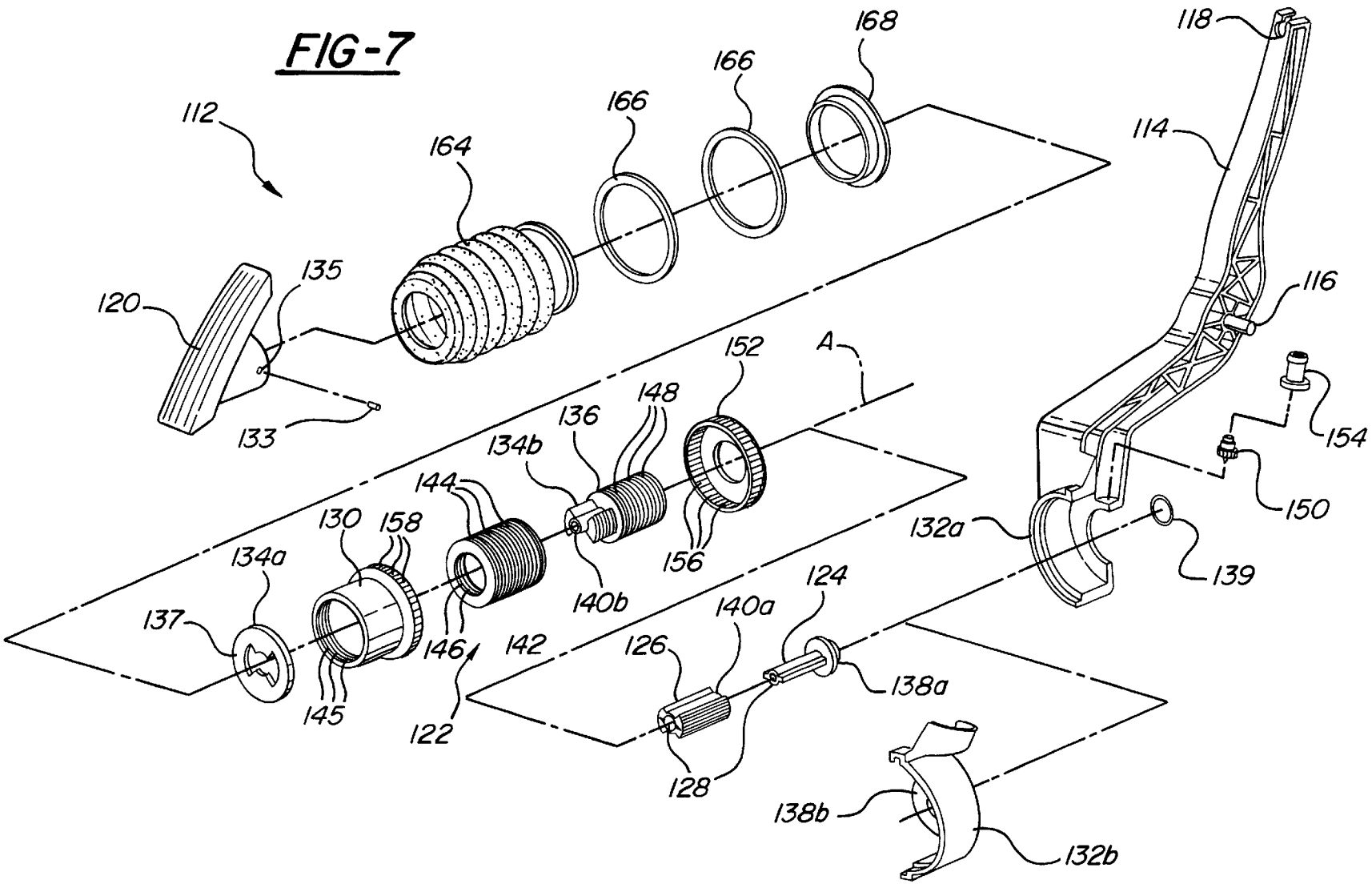
FIG. 7 is an exploded view of the components of the second embodiment.

The assembly is characterized by a separate and independent guide interconnecting the pedal pad 20, 120 and the pedal arm 14, 114 for stabilizing the movement of the pedal pad 20, 120 relative to the pedal arm 14, 114 along the adjustment axis A. More specifically, the guide includes a first telescoping element 24, 124 and a second telescoping element 26, 126 which are in sliding engagement with one another along a telescoping axis that extends in the same direction as the adjustment axis A. As will become more clear as the description proceeds, the telescoping axis is parallel to and spaced from the adjustment axis A in the first embodiment of FIGS. 2–5 whereas the telescoping axis is coaxial with the adjustment axis A in the embodiment of FIGS. 6 and 7. A tongue and groove connection 28, 128 prevents the first telescoping element 24, 124 from rotating relative to the second telescoping element 26, 126 about the telescoping axis.

The adjuster 22, 122 includes a plurality of screw members interconnected by threads for adjusting the position of the pedal pad 20, 120 along the adjustment axis A in response to relative rotation between the screw members. More specifically, a first screw member 30, 130 is rotatably supported by a housing 32, 132. The housing 132 in the second embodiment is in two parts 132*a* and 132*b*, which are secured together by appropriate fasteners.

A non-rotatable connection 34, 134*a* and 134*b* interconnects a second 36, 136 of the screw members and the pedal pad 20, 120. The pedal pad 120 of the second embodiment includes a U-shaped clip 135 which slides over the washer-like portion 134*a* of the non-rotatable connection and pins 133 extend through holes 137 to interconnect the portion 134*a* and the clip 135.

A first operative connection 38, 138*a* and 138*b* connects the first telescoping element 24, 124 to the housing 32, 132 for preventing relative rotation between the first telescoping element 24, 124 and the housing 32, 132. The first telescoping element 24 in the first embodiment is defined by a slideway in the housing 32 and the first operative connection 38 connecting the first telescoping element 24 to the housing 32 is defined by an integral portion of the housing 32. The first operative connection 138*a* and 138*b* in second embodiment that connects the first telescoping element 124 to the housing 32, 132 comprises a mechanical interlock defined by keys 138*a* which engage the slots 138*b* in the housing 132*b*. A snap ring 139 snaps into an annular groove in the end of the first telescoping element 124 to axially retain the first telescoping element 124 to the housing 132*b*. Accordingly, the first operative connection 38, 138*a* and 138*b* connects the first telescoping element 24, 124 to the housing 32, 132 to prevent relative axial movement between the first telescoping element 24, 124 and the housing 32, 132.

A second operative connection 40, 140*a* and 140*b* connects the second telescoping element 26, 126 to the second screw member 36, 136 for preventing relative rotation between the second telescoping element 26, 126 and the second screw member 36, 136. This second operative connection 40, 140*a* and 140*b*, which connects the second telescoping element 26, 126 to the second screw member 36, 136, permits relative axial movement between the second screw member 36, 136 and the second telescoping element 26, 126 as the second telescoping element 26, 126 moves along the telescoping axis relative to the first telescoping element 24, 124 The second operative connection 40 which connects the second telescoping element 26 to the second screw member 36 in the first embodiment comprises an integral portion of the pedal pad 20. A pair of plates 15 are fastened to the housing 32 to define the groove of the connection 28. A bottom plate 17 of the second telescoping element 26 defines the tongue of the connection 28 and is slidably disposed under the plates 15. Another plate 19 is slidably disposed between the side plates 15 and is sandwiched with the connecting slide 40 by a block 21. These components are held together by fasteners 23 which allow the plate 17 to slide in the groove of the connection 28 and the block 23 and plate 19 to slide relative to the integral connection 40 of the pedal pad 20. In some instances, the second telescoping element 26 may be non-axially movable relative to either the pedal pad connection 40 or to the housing 32. But in this embodiment, the second telescoping element 26 is slidable relative to both as the fasteners 23 slide along a slot 25 in the connecting portion 40. The second operative connection 140*a* and 140*b* which connects the second telescoping element 126 to the second screw member 136 in the second embodiment comprises co-acting splines on the outside of the second telescoping element 126 and on the inside of the second screw member 136.

The plurality of screw members includes an intermediate screw member 42, 142 having first threads 44, 144 in threaded engagement with the first screw member 30, 130 and second threads 46, 146 in threaded engagement with the second screw member 36, 136. The intermediate screw member 42, 142 is cylindrical with the first threads 44, 144 disposed about the exterior thereof and threadedly engaging the interior teeth 45, 145 of the first screw member 30, 130 and with the second threads 46, 146 disposed about the interior thereof and threadedly engaging threads 48, 148 on the exterior of the second screw member 36, 136.

The assembly also includes a drive mechanism for rotating the first screw member 30, 130. In the first embodiment, the drive mechanism includes a driven helical cable 50 which engages a gear 52 which, in turn, rotates the first screw member 30. In the second embodiment, the drive mechanism includes bevel gear 150 which meshes with a drive ring 152. The bevel gear 150 is rotated by a rotary cable (not shown) which is rotated by a motor and held in position by a retainer 154. The drive ring 152 has teeth 156 which mesh with teeth 158 on the first screw member 130. Also, in the second embodiment, the second telescoping element 126 surrounds the first telescoping element 124 and is disposed within the second screw member 136.

The assembly also includes stops for limiting telescoping movement between the first and second telescoping elements 26, 126. In the first embodiment, the stops comprise the radial flanges 60 and 62 between the screw members to define axial stops. In the second embodiment, the stops comprise ends to the threads to define rotary stops, i.e., abutting ends of the co-acting threads to limit relative rotation.

A boot 164 covers the assembly and is held to the pedal pad 120 and housing 132 by retainer rings 166. A first screw member retainer 168 holds the first screw member 130 in the housing 132.

In operation, as the first screw member 30, 130 is rotated by the drive mechanism and to move the intermediate screw member 42, 142 axially by the threaded 44, 45 and 45, 145 interaction, i.e., the pedal pad 20, 120 is moved axially to the extended position. When the first 30, 130 and intermediate 42, 142 screw members reach a stop limit of relative rotation, the intermediate screw member 42, 142 rotates to move the second screw member 36, 136 axially via the interaction of the threads 46, 48 146, 148. The drive mechanism is reversed to retract the screw members in the opposite direction.

During this extending and retracting movement of the pedal pad 20, 120, the first 24, 124 and second 26, 126 telescoping elements guide the axial movement of the pedal pad 20, 120 by preventing rotation of the pedal pad 20, 120 about the axis A of rotation of the screw members. In other words, the telescoping elements stabilize the axial movement of the pedal pad 20, 120, mainly to prevent rotation but with enough, it could completely control or direct the axial movement.

Obviously, many modifications and variations of the present invention are possible in light of the above teachings. The invention may be practiced otherwise than as specifically described within the scope of the appended claims, wherein that which is prior art is antecedent to the novelty set forth in the "characterized by" clause. The novelty is meant to be particularly and distinctly recited in the "characterized by" clause whereas the antecedent recitations merely set forth the old and well-known combination in which the invention resides. These antecedent recitations should be interpreted to cover any combination in which the inventive novelty has utility. In addition, the reference numerals are merely for convenience and are not to be in anyway to be read as limiting.

What is claimed is:

1. An adjustable pedal assembly for an automotive vehicle comprising;

a pedal arm (14, 114) having a distal end, a support (16, 116) supporting the pedal arm (14, 114) for pivotal movement on a vehicle, a pedal pad (20, 120) for receiving forces for pivoting said pedal arm (14, 114), and an adjuster (22, 122) supporting said pedal pad (20, 120) on said distal end of said pedal arm (14, 114) for adjusting the position of said pedal pad (20, 120) relative to said pedal arm (14, 114) along an adjustment axis (A), a sliding guide interconnecting said pad and said pedal arm (14, 114) for stabilizing said movement of said pad relative to said pedal arm (14, 114) along said adjustment axis (A), said guide including a first telescoping element (24, 124) and a second telescoping element (26, 126) which are in sliding engagement with one another along a telescoping axis that extends in the same direction as said adjustment axis (A), and a tongue and groove connection (28, 128) for preventing said first telescoping element (24, 124) from rotating relative to said second telescoping element (26, 126) about said telescoping axis.

2. An assembly as set forth in claim 1 wherein said adjuster (22, 122) includes a plurality of screw members interconnected by threads for adjusting said position of said pedal pad (20, 120) along said adjustment axis (A) in response to relative rotation between said screw members.

3. An assembly as set forth in claim 2 including a housing (32, 132) rotatably supporting a first of said screw members, a non-rotatable connection (34, 134) interconnecting a second (36, 136) of said screw members and said pedal pad (20, 120) a first operative connection (38, 138*a* and 138*b*) connecting said first telescoping element (24, 124) to said housing (32, 132) for preventing relative rotation between said first telescoping element (24, 124) and said housing (32, 132), a second operative connection (40, 140*a* and 140*b*) connecting said second telescoping element (26, 126) to said second screw member (36, 136) for preventing relative rotation between said second telescoping element (26, 126) and said second screw member (36, 136).

4. An assembly as set forth in claim 3 including stops for limiting telescoping movement between said first (24, 124) and second (26, 126) telescoping elements.

5. An assembly as set forth in claim 3 wherein said first operative connection (38, 138*a* and 138*b*) connecting said first telescoping element (24, 124) to said housing (32, 132) prevents relative axial movement between said first telescoping element (24, 124) and said housing (32, 132), and said second operative connection (40, 140*a* and 140*b*) connecting said second telescoping element (26, 126) to said second screw member (36, 136) permits relative axial movement between said second screw member and said second telescoping element (26, 126) as said second telescoping element (26, 126) moves along said telescoping axis relative to said first telescoping element (24, 124).

6. An assembly as set forth in claim 5 including a drive mechanism for rotating said first screw member (30, 130), said plurality of screw members includes an intermediate screw member having first threads (44, 144) in threaded engagement with said first screw member (30, 130) and second threads (46, 146) in threaded engagement with said second screw member (36, 136).

7. An assembly as set forth in claim 6 wherein said intermediate screw member is cylindrical with said first threads (44, 144) disposed about the exterior thereof and threadedly engaging said first screw member (30, 130) and with said second threads (46, 146) disposed about the interior thereof and threadedly engaging said second screw member (36, 136).

8. An assembly as set forth in claim 7 wherein said telescoping axis is parallel to and spaced from said adjustment axis (A).

9. An assembly as set forth in claim 8 wherein said first telescoping element (24, 124) is defined by a slideway in said housing (32, 132) and said first operative connection (38, 138*a* and 138*b*) connecting said first telescoping element (24, 124) to said housing (32, 132) is defined by an integral portion of said housing (32, 132).

10. An assembly as set forth in claim 7 wherein said telescoping axis is coaxial with said adjustment axis (A).

11. An assembly as set forth in claim 10 wherein said first operative connection (38, 138*a* and 138*b*) connecting said first telescoping element (24, 124) to said housing (32, 132) is defined by a mechanical interlock.

12. An assembly as set forth in claim 10 wherein said second telescoping element (26, 126) surrounds said first telescoping element (24, 124) and is disposed within said second screw member (36, 136).

13. An assembly as set forth in claim 12 wherein said second operative connection (40, 140*a* and 140*b*) connecting said second telescoping element (26, 126) to said second screw member (36, 136) comprises co-acting splines.

* * * * *